US011286716B2

(12) United States Patent
Gealy et al.

(10) Patent No.: US 11,286,716 B2
(45) Date of Patent: Mar. 29, 2022

(54) THREE SECTION EXTENSION LADDER AND METHOD

(75) Inventors: Preston L. Gealy, Youngstown, OH (US); Kevin L. McIntire, Stoneboro, PA (US); Robert D. Beggs, Stoneboro, PA (US)

(73) Assignee: Werner Co., Greenville, PA (US)

( * ) Notice: Subject to any disclaimer, the term of this patent is extended or adjusted under 35 U.S.C. 154(b) by 0 days.

(21) Appl. No.: 13/373,122

(22) Filed: Nov. 5, 2011

(65) Prior Publication Data

US 2013/0112501 A1 May 9, 2013

(51) Int. Cl.
*E06C 1/08* (2006.01)
*E06C 7/06* (2006.01)

(52) U.S. Cl.
CPC . *E06C 1/08* (2013.01); *E06C 7/06* (2013.01)

(58) Field of Classification Search
CPC ..... E06C 7/06; E06C 1/08
USPC ..... 182/129, 107, 109
See application file for complete search history.

(56) References Cited

U.S. PATENT DOCUMENTS 1,949,972 A * 3/1934 Murphy ..... E06C 1/12 182/212
2,760,706 A * 8/1956 Pearl ..... 182/211
3,464,522 A * 9/1969 Kramer ..... E06C 1/12 182/211
3,768,123 A * 10/1973 Forte ..... 24/300
5,762,242 A * 6/1998 Yost ..... A63C 11/021 224/250
5,896,945 A * 4/1999 Boelling ..... 182/107
6,193,012 B1 * 2/2001 Olivas ..... 182/129
6,269,909 B1 * 8/2001 Grimes et al. ..... 182/207
6,296,165 B1 * 10/2001 Mears ..... 224/610
6,935,464 B2 * 8/2005 Duan ..... 182/213
7,762,441 B1 * 7/2010 Benally ..... A63C 11/025 224/257
2008/0185223 A1 * 8/2008 Lem ..... E06C 1/32 182/116
2013/0009414 A1 * 1/2013 LeClaire et al. ..... 294/151

* cited by examiner

*Primary Examiner* — Alvin C Chin-Shue
(74) *Attorney, Agent, or Firm* — Ansel M. Schwartz

(57) ABSTRACT

An extension ladder including a base section having two side rails with rungs spanning horizontally between them. The extension ladder including an intermediate fly section having two side rails with rungs spanning horizontally between them. The intermediate fly section slidably attached to the base section. The extension ladder including a top fly section having two side rails with rungs spanning horizontally between them, the top fly section sliding attached to the intermediate fly section with the intermediate fly section disposed between the base and the top fly section. The extension ladder including a handle having a first strap portion attached to the base section having a first buckle portion, and a second strap portion attached to the top fly section having a second buckle portion that engages with the first buckle portion when the base section, intermediate fly section and top fly section are in a folded state. A method of moving an extension ladder.

6 Claims, 7 Drawing Sheets

THREE SECTION EXTENSION LADDER AND METHOD

FIELD OF THE INVENTION

The present invention is related to an extension ladder having a base section, intermediate fly section and top fly section that is lifted by a handle formed from a first strap portion attached to a base section and a second strap portion attached to a top fly section. (As used herein, references to the "present invention" or "invention" relate to exemplary embodiments and not necessarily to every embodiment encompassed by the appended claims.) More specifically, the present invention is related to an extension ladder having a base section, intermediate fly section and top fly section that is lifted by a grip of a handle formed from a first strap portion section having a first buckle portion attached to a base section and a second strap portion attached to the top fly section having a second buckle portion that engages with the first buckle portion attached to a top fly section.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

Typical extension ladders have two sections (base and fly) to permit length adjustment to access desired working heights. A two section extension ladder typically comes in 16', 20', 24', 28', 32', 36' and 40' sizes. When two section extension ladders are fully retracted, they can measure about 8', 10', 12', 14', 16', 18' and 20' in overall length. These retracted lengths can be bulky and make maneuverability, indoor use, storage and transportation difficult.

BRIEF SUMMARY OF THE INVENTION

The present invention pertains to a new three section extension ladder design that will improve the maneuverability, indoor use, storage and transportation of a two section extension ladder.

The present invention pertains to an extension ladder. The extension ladder comprises a base section having two side rails with rungs spanning horizontally between them that are fixed a set distance apart. The extension ladder comprises an intermediate fly section having two side rails with rungs spanning horizontally between them that are fixed a set distance apart, the intermediate fly section slidably attached to the base section. The extension ladder comprises a top fly section having two side rails with rungs spanning horizontally between them that are fixed a set distance apart, the top fly section sliding attached to the intermediate fly section with the intermediate fly section disposed between the base and the top fly section. The extension ladder comprises a handle having a first strap portion attached to the base section having a first buckle portion, and a second strap portion attached to the top fly section having a second buckle portion that engages with the first buckle portion when the base section, intermediate fly section and top fly section are in a folded state where they essentially form a shape of a cube so the base section, intermediate fly section and top fly section can be lifted by the handle, and a grip positioned about the second strap portion.

The present invention pertains to an extension ladder. The extension ladder comprises a base section having two side rails, each having a cross-sectional shape of a C facing towards a centerline, with rungs spanning horizontally between them that are fixed a set distance apart. The extension ladder comprises an intermediate fly section having two side rails, each having a cross-sectional shape of a C facing away from the centerline, with rungs spanning horizontally between them that are fixed a set distance apart. The intermediate fly section is slidably attached to the base section. The extension ladder comprises a top fly section having two side rails, each having a cross-sectional shape of a C facing towards a centerline, with rungs spanning horizontally between them that are fixed a set distance apart. The top fly section is slidingly attached to the intermediate fly section with the intermediate fly section disposed between the base and the top fly section. The C shape of the rails of the base and top fly sections interlocking with the C shape of the rails of the intermediate fly section. The extension ladder comprises a handle that engages with the base section, intermediate fly section and top fly section when they are in a folded state where they essentially form a shape of a cube so the base section, intermediate fly section and top fly section can be lifted by the handle.

The present invention pertains to an extension ladder. The extension ladder comprises a base section having two side rails, each having a cross-sectional shape of a C facing towards a centerline, with rungs spanning horizontally between them that are fixed a set distance apart. The extension ladder comprises an intermediate fly section having two side rails with rungs spanning horizontally between them that are fixed a set distance apart. The intermediate fly section is slidably attached to the base section. The intermediate fly section has two pivoting ladder lock mechanisms located near the bottom of the intermediate fly section to prohibit movement of the intermediate fly section along a center line of the ladder towards ground when the base, intermediate fly and top fly sections are in an extended state. Each locking mechanism has a flipper which prevents a rung from engaging a lock of the lock mechanism during ladder length adjustment. The extension ladder comprises a top fly section having two side rails with rungs spanning horizontally between them that are fixed a set distance apart. The top fly section is slidingly attached to the intermediate fly section with the intermediate fly section disposed between the base and the top fly section. The extension ladder comprises a handle that engages with the base section, intermediate fly section and top fly section when they are in a folded state where they essentially form a shape of a cube so the base section, intermediate fly section and top fly section can be lifted by the handle.

The present invention pertains to a method of moving an extension ladder. The method comprises the steps of moving a base section having two side rails with rungs spanning horizontally between them that are fixed a set distance apart, an intermediate fly section having two side rails with rungs spanning horizontally between them that are fixed a set distance apart, the intermediate fly section slidably attached to the base section, and a top fly section having two side rails with rungs spanning horizontally between them that are fixed a set distance apart, the top fly section sliding attached to the intermediate fly section with the intermediate fly section disposed between the base and the top fly section into a folded state where they essentially form a shape of a cube. There is the step of engaging a first buckle portion of a first strap portion attached to the base section with a second strap portion attached to the top fly section to form a handle.

There is the step of grabbing a grip positioned about the second strap portion. There is the step of lifting the base section, intermediate fly section and top fly section by the handle.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
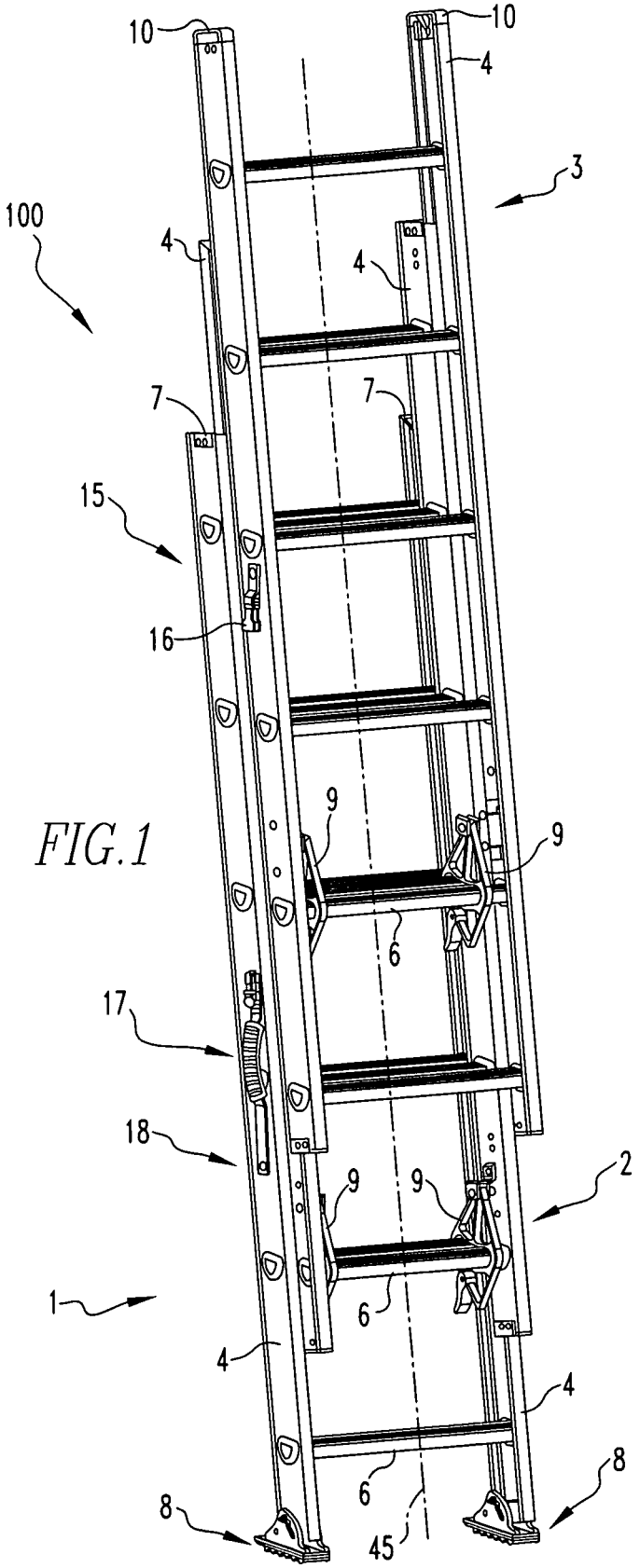
FIG. 1 is a perspective view of the extension ladder of the present invention in the extended state.
Figure 2:
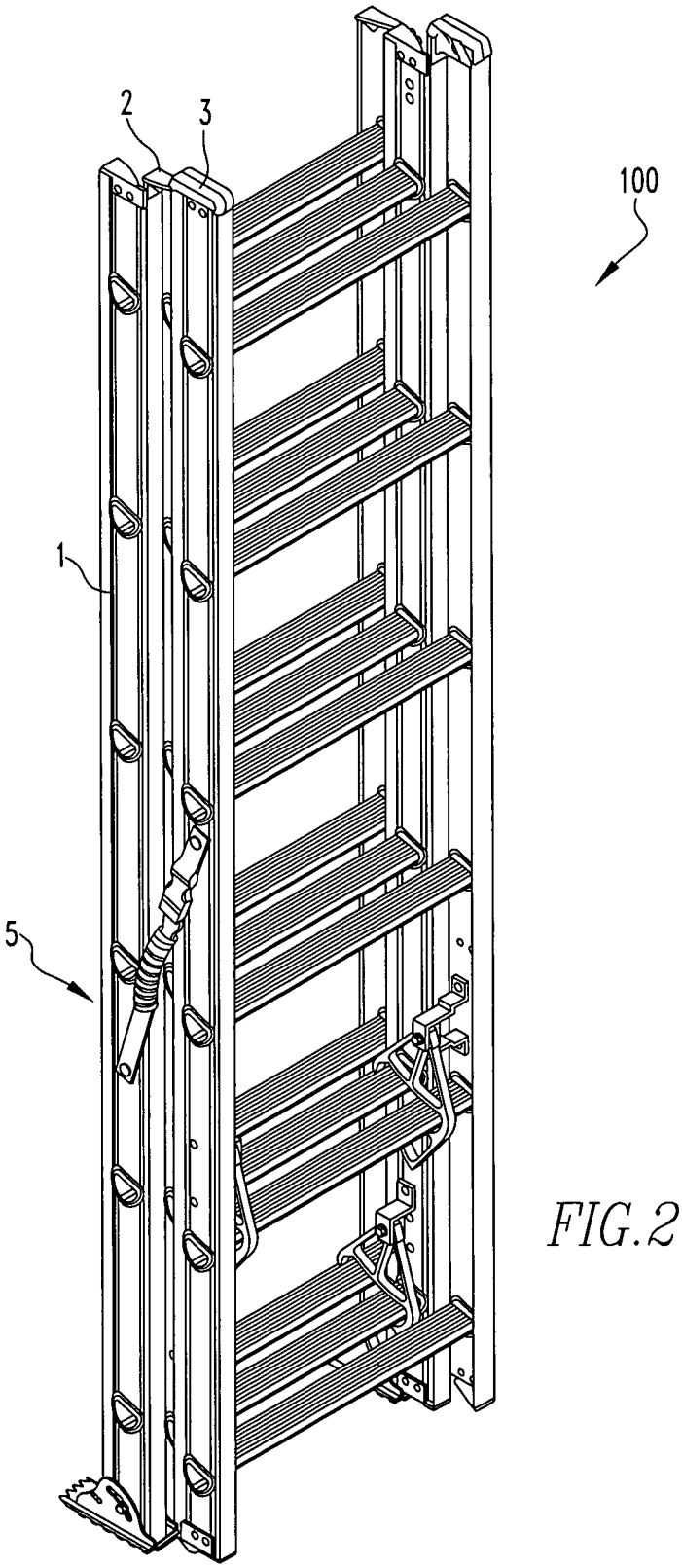
FIG. 2 is a perspective view of the extension ladder of the present invention in the folded state.
Figure 3:
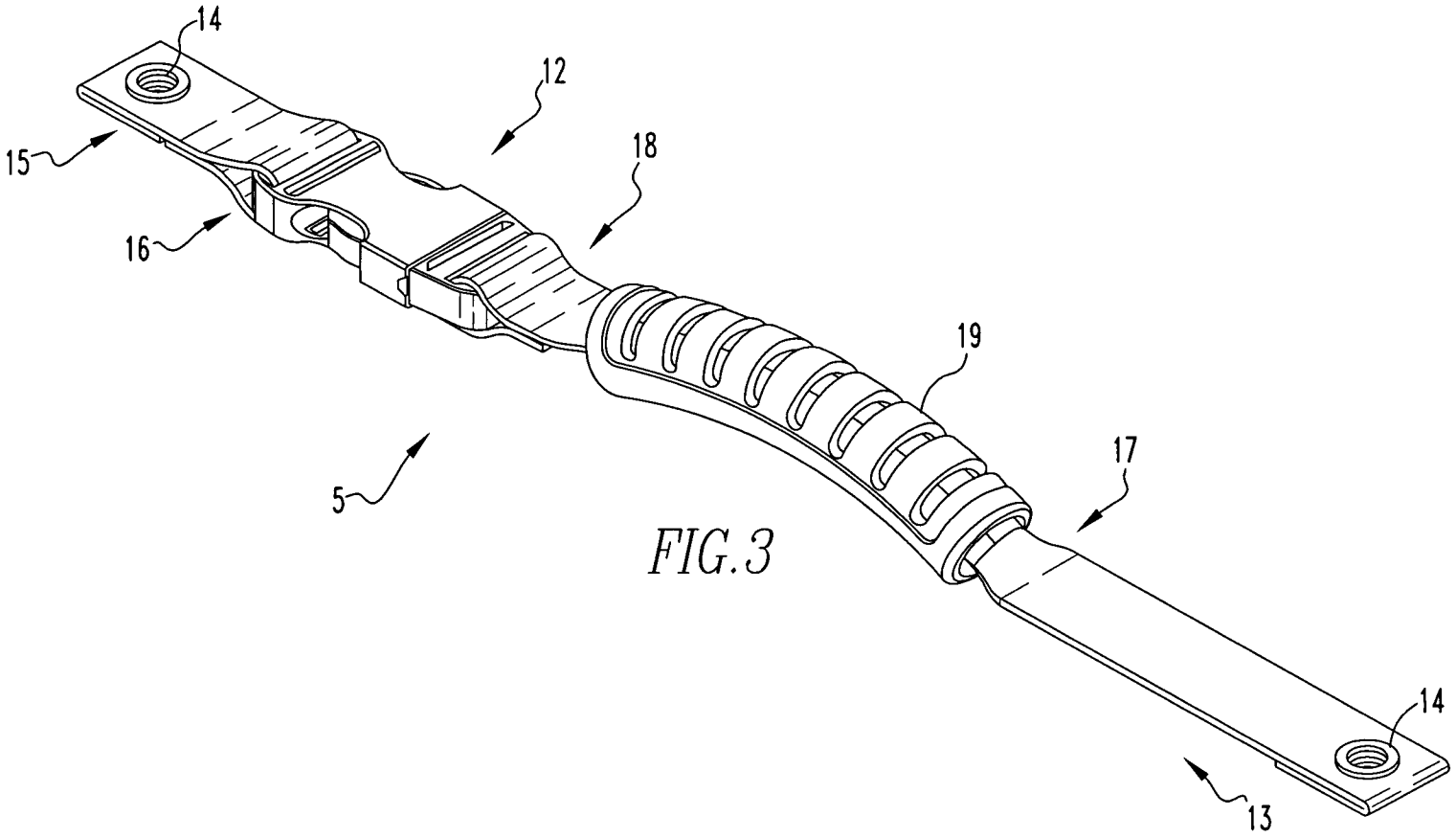
FIG. 3 is a perspective view of the handle of the present invention.

Referring now to the drawings wherein like reference numerals refer to similar or identical parts throughout the several views, and more specifically to FIG. 1 thereof, there is shown an extension ladder. The ladder 100 may be made out of aluminum or fiberglass. The extension ladder comprises a base section 1 having two side rails 4 with rungs 6 spanning horizontally between them that are fixed a set distance apart. The extension ladder comprises an intermediate fly section 2 having two side rails 4 with rungs 6 spanning horizontally between them that are fixed a set distance apart, the intermediate fly section 2 slidably attached to the base section 1. The extension ladder comprises a top fly section 3 having two side rails 4 with rungs 6 spanning horizontally between them that are fixed a set distance apart, the top fly section 3 sliding attached to the intermediate fly section 2 with the intermediate fly section 2 disposed between the base and the top fly section 3. The extension ladder comprises a handle 5, as shown in FIG. 3, having a first strap portion 15 attached to the base section 1 having a first buckle portion 16, and a second strap portion 17 attached to the top fly section 3 having a second buckle portion 18 that engages with the first buckle portion 16 when the base section 1, intermediate fly section 2 and top fly section 3 are in a folded state, as shown in FIG. 2, where they essentially form a shape of a cube so the base section 1, intermediate fly section 2 and top fly section 3 can be lifted by the handle 5, and a grip 19 positioned about the second strap portion 17.

The base section 1 may have two pivoting feet 8 located at the bottom of the base section 1 which allows adjustability for undesirable ground surfaces when the base, intermediate fly and top fly sections 2, 3 are in an extended state, where the top of the intermediate fly section is higher than the top of the base section and the top of the top fly section is higher than the top of the intermediate fly section relative to ground and the ladder is then able to rest against a structure at an angle and a user can climb the ladder. The intermediate fly section 2 may have two pivoting ladder lock mechanisms located near the bottom of the intermediate fly section 2 to prohibit movement of the intermediate fly section 2 along a center line of the ladder towards the ground surface when the base, intermediate fly and top fly sections 2, 3 are in the extended state. The top fly section 3 may have two pivoting ladder lock mechanisms located near the bottom of the top fly section 3 to prohibit movement of the top fly section 3 along the centerline of the ladder towards the ground surface. The top fly section 3 may have two end caps when the base, intermediate fly and top fly sections 2, 3 are in the extended state. In the extended state, the intermediate fly section 2 extends above from the base section 1, and the top fly section 3 extends above from the intermediate fly section 2 so the base, intermediate fly and top fly section 3 form a step function.

The present invention pertains to a method of moving an extension ladder. The method comprises the steps of moving a base section 1 having two side rails 4 with rungs 6 spanning horizontally between them that are fixed a set distance apart, an intermediate fly section 2 having two side rails 4 with rungs 6 spanning horizontally between them that are fixed a set distance apart, the intermediate fly section 2 slidably attached to the base section 1, and a top fly section 3 having two side rails 4 with rungs spanning horizontally between them that are fixed a set distance apart, the top fly section 3 sliding attached to the intermediate fly section 2 with the intermediate fly section 2 disposed between the base and the top fly section 3 into a folded state where they essentially form a shape of a cube. There is the step of engaging a first buckle portion 16 of a first strap portion 15 attached to the base section 1 with a second strap portion 17 attached to the top fly section 3 to form a handle 5. There is the step of grabbing a grip 19 positioned about the second strap portion 17. There is the step of lifting the base section 1, intermediate fly section 2 and top fly section 3 by the handle 5.

There may be the step of prohibiting movement of the intermediate fly section 2 along a center line of the ladder towards the ground surface with two pivoting ladder lock mechanisms located near the bottom of the intermediate fly section 2 when the base, intermediate fly and top fly sections 2, 3 are in the extended state. There may be the step of prohibiting movement of the top fly section 3 along the centerline of the ladder towards the ground surface with two pivoting ladder lock mechanisms located near the bottom of the top fly section 3 when the base, intermediate fly and top fly sections 2, 3 are in the extended state. The top fly section 3 may have two end caps. The base section 1 may have two pivoting feet 8 located at the bottom of the base section 1 which allows adjustability for undesirable ground surfaces when the base, intermediate fly and top fly sections 2, 3 are in the extended state.

The present invention pertains to an extension ladder 100. The extension ladder 100 comprises a base section 1 having two side rails, each having a cross-sectional shape of a C facing towards a centerline 45, with rungs spanning horizontally between them that are fixed a set distance apart. The extension ladder comprises an intermediate fly section 2 having two side rails, each having a cross-sectional shape of a C facing away from the centerline 45, with rungs spanning horizontally between them that are fixed a set distance apart. The intermediate fly section 2 is slidably attached to the base section 1. The extension ladder 100 comprises a top fly section 3 having two side rails, each having a cross-sectional shape of a C facing towards a centerline 45, with rungs spanning horizontally between them that are fixed a set distance apart. The top fly section 3 is slidingly attached to the intermediate fly section 2 with the intermediate fly section 2 disposed between the base and the top fly section. The C shape of the rails of the base and top fly sections interlocking with the C shape of the rails of the intermediate fly section 2. The extension ladder comprises a handle that engages with the base section, intermediate fly section and top fly section when they are in a folded state where they essentially form a shape of a cube so the base section, intermediate fly section and top fly section can be lifted by the handle.

The present invention pertains to an extension ladder 100. The extension ladder 100 comprises a base section 1 having two side rails, with rungs spanning horizontally between them that are fixed a set distance apart. The extension ladder 100 comprises an intermediate fly section 2 having two side rails with rungs spanning horizontally between them that are fixed a set distance apart. The intermediate fly section 2 is slidably attached to the base section 1, the intermediate fly section 2 has two pivoting ladder lock mechanisms 9 located near the bottom of the intermediate fly section 2 to prohibit movement of the intermediate fly section 2 along a center line 45 of the ladder 100 towards ground when the base, intermediate fly and top fly sections are in an extended state. Each locking mechanism 9 has a flipper 18 which prevents a rung from engaging a lock of the lock mechanism during ladder length adjustment. The extension ladder comprises a top fly section having two side rails with rungs spanning horizontally between them that are fixed a set distance apart. The top fly section is slidingly attached to the intermediate fly section with the intermediate fly section disposed between the base and the top fly section. The extension ladder comprises a handle that engages with the base section, intermediate fly section and top fly section when they are in a folded state where they essentially form a shape of a cube so the base section, intermediate fly section and top fly section can be lifted by the handle.

In the operation of the invention, a simplified 3 section extension ladder is shown in FIG. 1. There are three major sections [base 1, intermediate fly 2 and top fly 3]. The sections are held together by interlocking side rails 4 which allow adjustability along the centerline of the ladder. The section travel is limited by the use of stop brackets attached to the side rails 4. There is a carrying handle 5 located on the side rails 4 that serve as means to make the 3 section extension ladder portable and also to prohibit the sections from extending when lifting, carrying or transporting the ladder.

The base section 1 has two side rails 4 with rungs 6 spanning horizontally between them and are fixed a set distance apart by a connection means. There are two rail closures 7 fastened near the end of the rail to protect the end user from sharp edges of each side rail 4 at the top of the section. There are two pivoting feet 8 located at the bottom of the section which allow adjustability for undesirable ground surfaces.

The intermediate fly 2 section has two side rails 4 with rungs 6 spanning horizontally between them and are fixed a set distance apart by a connection means. There are four rail closures 7 to protect the end user from sharp edges of each side rail 4 at the top and bottom of the section. There are two pivoting ladder lock mechanisms 9 located near the bottom of the section to prohibit movement of the intermediate fly 2 section along the centerline of the ladder towards the ground surface.

The top fly 3 section has two side rails 4 with rungs 6 spanning horizontally between them and are fixed a set distance apart by a connection means. There are two end caps 10 and two rail closures 7 to protect the end user from the cut edges of each side rail 4 at the top and bottom of the section. There are two pivoting ladder lock mechanisms 9 located near the bottom of the section to prohibit movement of the top fly 3 section along the centerline of the ladder towards the ground surface.

FIG. 3 is a detailed view of the carrying handle 5. The carrying handle 5 will be made up of multiple components. There will be a plastic molded handle 11 for user comfort when transporting the ladder. There will be a buckle 12 that when clasped, will restrict major movement of the ladder sections and create a means for the user to transport the ladder. There will be a strap 13 connecting all of the carrying handle 5 components together. The carrying handle 5 will be attached to the base section 1 and the top fly 3 section by means of a fastener 14 through the side rail 4.

Figure 4:
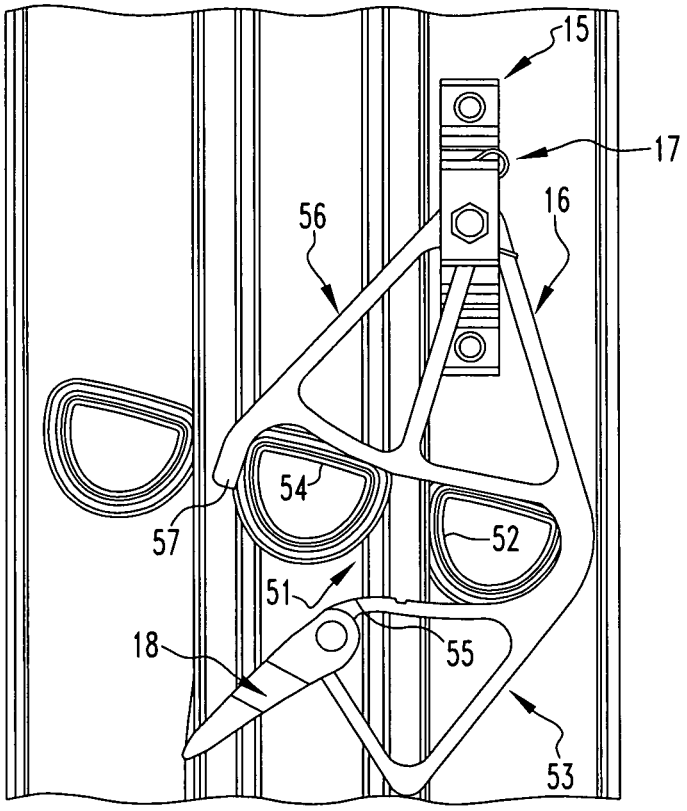
FIG. 4 is a detailed side view of a lock mechanism of the ladder.

FIG. 4 is a detailed view of the area near one of the top fly section lock mechanisms 9. The lock mechanism 9 is made up of four components: lock bracket 15, lock 16, spring 17 and flipper 18. The lock bracket 15 will be permanently attached to the inside of the ladder rail. The lock 16 will be pivotally attached to the lock bracket 15 and utilize a spring 17 integrated into the lock mechanism 9 to provide a constant torque on the lock 16 so that it properly engages the rungs when locking the ladder or the flipper 18 during ladder length adjustment.

The issue with the use of a pivoting ladder locking mechanism is in the interaction between the flipper 18 and the rungs. When the lock is in the unlocked position (see FIG. 5) and the top fly section 3 is allowed to move downward, the flipper 18 can wedge between the rungs on the base section 2 and the rungs on the intermediate fly 2. The geometry of the flipper 18 has been created to prevent such an issue.

Figure 7:
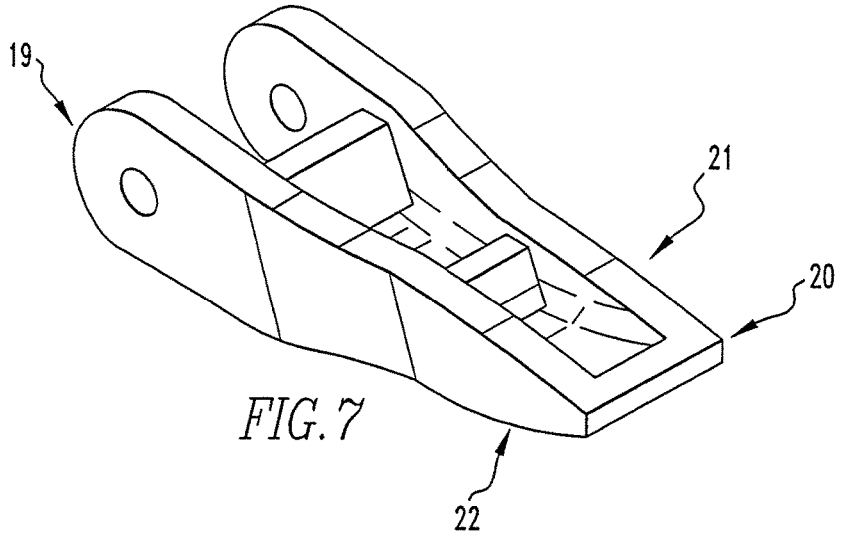
FIG. 7 shows a flipper of the present invention.

The flipper 18 is pivotally attached to the lock 16 and serves as a means to prevent the ladder rungs 6 from engaging the lock 16 during ladder length adjustment. The flipper 18 will have a first end 19 that contains means for attaching to the lock 16, such as a pin or rivet, and a second end 20 with a rounded tip. The tip is formed by a top convex surface 21 and a bottom convex surface 22 that converge at the second end, as shown in FIG. 7.

Figure 5:
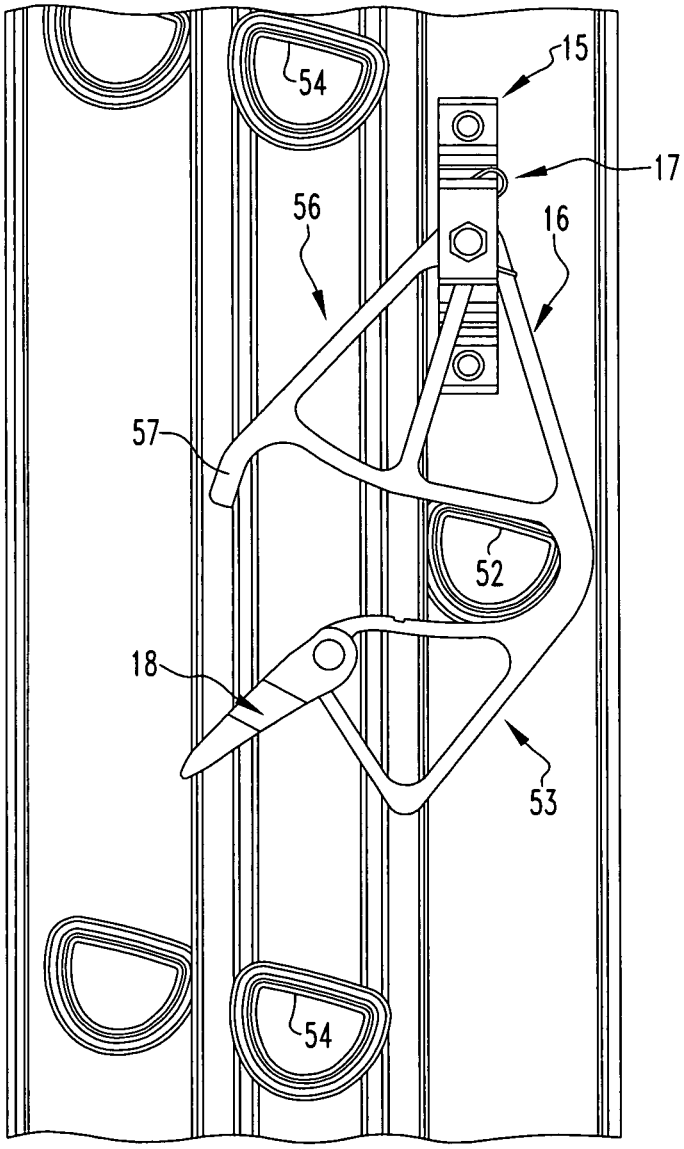
FIG. 5 is a detailed view of the lock mechanism with the top fly section moved up relative to the base and intermediate fly sections.
Figure 6:
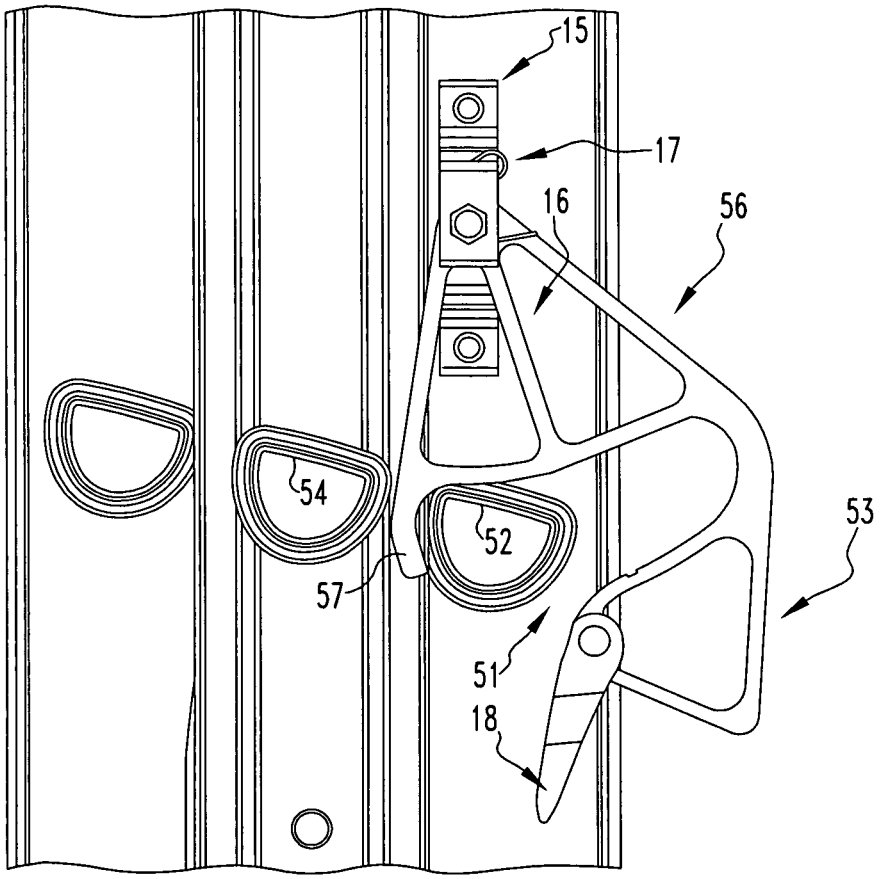
FIG. 6 is a detailed view of the lock mechanism with the top fly section moved back toward the locked position.

To better understand the operation of the lock mechanism 9 and the flipper 18, with reference to FIG. 4, the extension process can begin by moving the top fly section 3 upward relative to the base and intermediate fly sections. The envelope 51 of the locking mechanism which captures the rung 52, moves with the top fly section 3. As the locking mechanism moves up, the lower portion 53 contacts the rung 54 at point 55, causing the lock 16 to rotate counterclockwise as it moves up so the lock mechanism 9 clears the rung 54, as shown in FIG. 5.

To close the ladder 100 to the folded state, starting from FIG. 5 in regard to the top fly section 3 relative to the other two sections, the top fly section is moved down so the rung 52 is below rung 54, basically as shown again in FIG. 5 for illustration purposes, and then moved upwards. As it moves down, the flipper 18 contacts rung 54, which closes the flipper and causes the lock mechanism 9 to rotate counterclockwise out of the way of the rung 54, so it clears the rung 54. As the lock mechanism moves up, its upper portion 56 contacts the rung 54, which again causes the lock mechanism to rotate counterclockwise so the upper portion 56 clears the rung 54, and the hook 57 of the upper portion 56 to catch rung 52 and be positioned alongside rung 54. By continuing to lift the top fly section 3 slightly so the hook 57 clears rung 54, the force of the spring 17 causes the lock mechanism 9 to rotate clockwise and back into the locked position shown in FIG. 4. The top and bottom convex shapes on the flipper 18 facilitate the movement of the rung 54 against the flipper both when moving up or down, so the flipper 18 does not catch against the rung 54, and thus the lock mechanism is free to rotate as desired.

Figure 8:
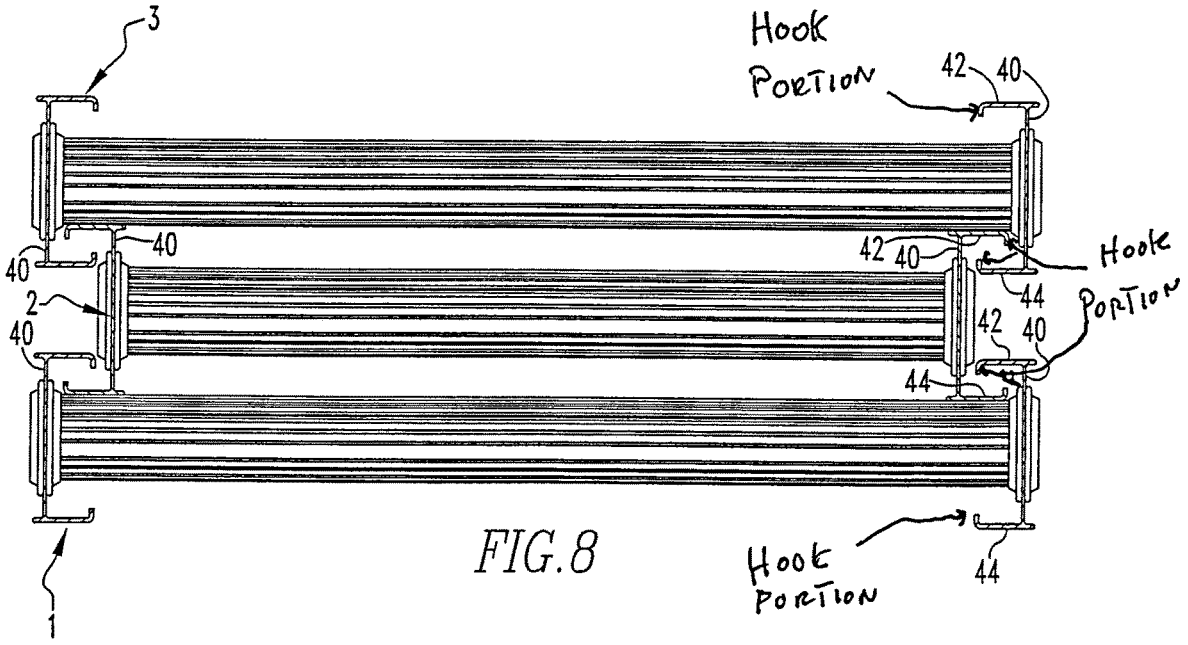
FIG. 8 is a detailed overhead view of the interlock nails of the base, intermediate and top fly sections.

FIG. 8 is a detailed view of the ladder showing the technique of interlocking the base 1, intermediately fly 2 and top fly 3 rails. All rails form a "C" shape when looking down the centerline. Both rails in the base section 1 are oriented such that the opening of the "C" is facing the centerline of the ladder. Both rails in the intermediate fly section 2 are oriented such that the opening of the "C" is facing away from the centerline of the ladder. Both rails in the top fly section 3 are oriented such that the opening of the "C" is facing the centerline of the ladder.

By the "C" of the rails of the top fly and base sections facing the "C" of the intermediate fly section 2, the rails interlock and prevent the sections from coming apart. In other words, each rail has a web 40 at its center and a first flange 42 and a second flange 44 extending from each side of the web 40. The base and top fly sections have their flanges extending toward the centerline 45 of the ladder, while the flanges of the intermediate fly section 2 extend away from the centerline 45.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A method of moving an extension ladder comprising steps of:

sliding a top fly section of the extension ladder along an intermediate fly section of the extension ladder and the intermediate section along a base section of the extension ladder into an extended state;

sliding the base section having two side rails with steps spanning horizontally between them that are fixed a set distance apart, the intermediate fly section having two side rails with steps spanning horizontally between them that are fixed a set distance apart, the intermediate fly section slidably attached to the base section, and the top fly section having two side rails with steps spanning horizontally between them that are fixed a set distance apart, the top fly section slidably attached to the intermediate fly section with the intermediate fly section disposed between the base and the top fly section into a folded state where they essentially form a shape of a cube, the sections are held together by interlocking their side rails which allow adjustability along a centerline of the ladder, the two side rails of the intermediate fly section interlocking with the two side rails of the base and top fly sections, each rail has a web at its center and a first flange and a second flange extending from each side of the web forming a c shape, the c shape of the rails of the top and bottom fly sections facing the c shape of the intermediate fly section and interlocking;

engaging a first buckle portion of a first strap portion attached directly to only a web of one of the two side rails of the base section with a second strap portion attached directly to only a web of one of the two side rails of the top fly section to form a handle to prohibit the base, intermediate and top fly sections from extending when lifting, carrying or transporting the ladder;

grabbing a grip positioned about the second strap portion; and lifting the base section, intermediate fly section and top fly section by the handle.

2. The method of claim 1 including the step of prohibiting movement of the intermediate fly section along a center line of the ladder towards the ground surface with two pivoting ladder lock mechanisms located near the bottom of the intermediate fly section when the base, intermediate fly and top fly sections are in the extended state, the lock mechanisms each having a spring to provide a constant torque so the lock mechanism properly engages the steps when locking the ladder during ladder length adjustment.

3. The method of claim 2 including the step of prohibiting movement of the top fly section along the centerline of the ladder towards the ground surface with two pivoting ladder lock mechanisms located near the bottom of the top fly, section when the base, intermediate fly and top fly sections are in the extended state.

4. The method of claim 3 wherein the top fly section has two end caps.

5. The method of claim 4 wherein the base section has two pivoting feet located at the bottom of the base section which allows adjustability for undesirable ground surfaces when the base, intermediate fly and top fly sections are in the extended state.

6. The method of claim 5 wherein each lock mechanism has a flipper which prevents a step from engaging the lock mechanism during ladder length adjustment.

* * * * *